US010507953B1

(12) United States Patent
Worsham

(10) Patent No.: US 10,507,953 B1
(45) Date of Patent: Dec. 17, 2019

(54) FLUID OR GRANULAR MATERIAL PACKAGING CONTAINER AND METHOD OF USE

(71) Applicant: Jack W. Worsham, Greensboro, NC (US)

(72) Inventor: Jack W. Worsham, Greensboro, NC (US)

( * ) Notice: Subject to any disclaimer, the term of this patent is extended or adjusted under 35 U.S.C. 154(b) by 0 days.

(21) Appl. No.: 16/023,585

(22) Filed: Jun. 29, 2018

(51) Int. Cl.

| | |
|---|---|
| ***B65D 21/02*** | (2006.01) |
| ***B65D 1/02*** | (2006.01) |
| ***B65D 81/36*** | (2006.01) |
| ***B65D 23/10*** | (2006.01) |
| *B65D 83/00* | (2006.01) |

(52) U.S. Cl.
CPC ..... *B65D 21/0215* (2013.01); *B65D 1/0207* (2013.01); *B65D 23/10* (2013.01); *B65D 81/365* (2013.01); *B65D 83/00* (2013.01)

(58) Field of Classification Search
CPC .. B65D 21/0215; B65D 23/10; B65D 81/365; B65D 1/0207; B65D 83/00
USPC ..... 222/143
See application file for complete search history.

(56) References Cited

U.S. PATENT DOCUMENTS

| | | | | |
|---|---|---|---|---|
| 3,194,426 | A * | 7/1965 | Brown, Jr. | B65D 21/0204 220/23.4 |
| 6,006,935 | A * | 12/1999 | Driver | B65D 25/48 220/23.4 |
| 6,719,161 | B1 * | 4/2004 | Craig | B65D 1/14 220/23.4 |
| 2007/0246488 | A1 * | 10/2007 | Cash | B65D 1/20 222/466 |
| 2012/0325866 | A1 * | 12/2012 | Lee | B65D 21/0231 222/466 |

* cited by examiner

*Primary Examiner* — Donnell A Long
(74) *Attorney, Agent, or Firm* — Tuggle Duggins P.A.; Blake P. Hurt

(57) ABSTRACT

A packaging container for the transportation and distribution of fluids, pellets, and granular materials, that may also be used as a building material. The packaging container includes two protrusions extending from the packaging container exterior surface and forms two recesses in the packaging container exterior surface, the protrusions and recesses sized and shaped so that a protrusion can be inserted within a recess to link two or more packaging containers together in an effort to construct a structure. The packaging container also has a notch and channel defined in the exterior surface, each sized and shaped to receive a container spout and handle therein, so that a flush engagement can be achieved when connecting a significant number of containers in the construction of a large structure, such as a wall of a dwelling. A method of utilizing the packaging containers in this manner is also provided.

15 Claims, 6 Drawing Sheets

FLUID OR GRANULAR MATERIAL PACKAGING CONTAINER AND METHOD OF USE

FIELD OF THE INVENTION

The invention herein pertains to containers for the storage of fluids, pellets, or granular materials generally, and particularly pertains to an apparatus for and a method of storing potable fluids such as water within a container that, when no longer holding water therein, can be interconnected with other containers for the construction of small and larger structures.

DESCRIPTION OF THE PRIOR ART AND OBJECTIVES OF THE INVENTION

It is becoming increasingly clear that the most valuable resource on Earth is not oil or gold, but water. Fresh, clean water suitable for human consumption (i.e. potable), to say nothing of water for cooking, cleaning, and the like, is a commodity that the "haves" are stockpiling in increasing supply while the "have-nots" are seeking with increasing desperation. Of the many issues facing those who wish to provide those in need with fresh water, the simple logistics of transporting the liquid from its source to those in need are among the most challenging. Water needs to be maintained in a clean environment during transportation, or it is useless upon arrival without expensive or time-consuming procedures, so it is commonplace to transport water within closed containers. These containers become exceedingly heavy when loaded, so their shipment is necessarily complex and expensive. Further, once the water arrives at its destination, the people who need it most must either use it at the delivery site (unlikely) or transport it in smaller vessels back to their homes, further decreasing the likelihood that the water will be used as needed. Last but not least, the containers themselves must either be discarded, leading to significant environmental waste, or transported back in the manner from which they came, further increasing the transportation cost of this potentially life-saving exercise.

To make matters even worse, many of the poorest nations on Earth suffer from inadequate building materials, leading to substandard housing and structurally deficient structures. Many of the same logistics and cost challenges face entities who would otherwise be willing to provide building materials to the less fortunate. Thus, in view of the problems and disadvantages associated with prior art water storage vessels, and further in view of the need for building materials in many of the same locations, the present invention was conceived and one of its objectives is to provide a fluid storage vessel that is easy to manufacture and simple to use.

It is another objective of the present invention to provide a polymeric water storage vessel that defines a substantially hollow interior therein, sized and shaped for the receipt and retention of potable water.

It is still another objective of the present invention to provide a fluid packaging container defining at least one protrusion formed on the exterior surface thereof, and at least one recess formed in the exterior thereof, the protrusion sized and shaped to nest within the recess and the recess sized and shaped to receive substantially all of the protrusion therein.

It is yet another objective of the present invention to provide a fluid packaging container including a handle defined on the exterior surface thereof for ergonomic holding of the packaging container while containing fluid such as potable water therein.

It is a further objective of the present invention to provide a fluid packaging container further defining a channel formed in the exterior surface thereof, the channel sized and shaped to receive substantially all of the handle therein.

It is still a further objective of the present invention to provide a fluid packaging container defining a plurality of protrusions formed on the exterior surface thereof, and a plurality of recesses formed in the exterior thereof, the protrusions sized and shaped to nest within different ones of the recesses and the recesses sized and shaped to receive substantially all of different ones of the protrusions therein.

It is another objective of the present invention to provide a fluid, pellet, or granular material packaging container that can house a variety of potable (i.e. water, milk, juice, soda, and other non-carbonated beverages), edible (salt, sugar, flour, syrup, beans, and rice), and non-potable (oil, gasoline, paint, rubber, and paint thinner) materials therein, and thereafter utilize the packaging container to assemble a structure.

It is yet a further objective of the present invention to provide a method of forming a structure comprising the steps of providing a plurality of fluid packaging containers, each of the containers defining at least one protrusion and at least one recess, and engaging the plurality of fluid packaging containers together to assemble a structure. Non-limiting examples of such structures include homes, garages, playhouses, treehouses, dog houses, pool houses, observation towers, and the like.

Various other objectives and advantages of the present invention will become apparent to those skilled in the art as a more detailed description is set forth below.

SUMMARY OF THE INVENTION

The aforesaid and other objectives are realized by providing a generally hollow, cube-shaped fluid container formed out of a polymeric material for the storage of a variety of items, particularly, clean, potable fluids such as water, milk, juice, or the like therein. Each container defines two square-shaped protrusions extending from different ones of the exterior surface of the container, and two similarly sized and shaped recesses formed in separate exterior surfaces of the container. The protrusion extensions form a small shoulder that is insertable into the recesses to form a firm mechanical engagement therebetween. Each container also defines a cylindrical handle and a spout and respectively a correspondingly sized and shaped channel and notch in an exterior surface, such that the handle and spout are insertable within the respective channel and notch to establish another point of mechanical attachment. In use, the containers are emptied of their contained substances and mechanically engaged with one another, protrusions inserted within recesses and handles/spouts positioned within channels/notches, and in this matter sizable structures such as the walls of a house can be formed from the containers after their role as fluid packaging containers is fulfilled.

DETAILED DESCRIPTION OF THE PREFERRED EMBODIMENT AND OPERATION OF THE INVENTION

Figure 1:
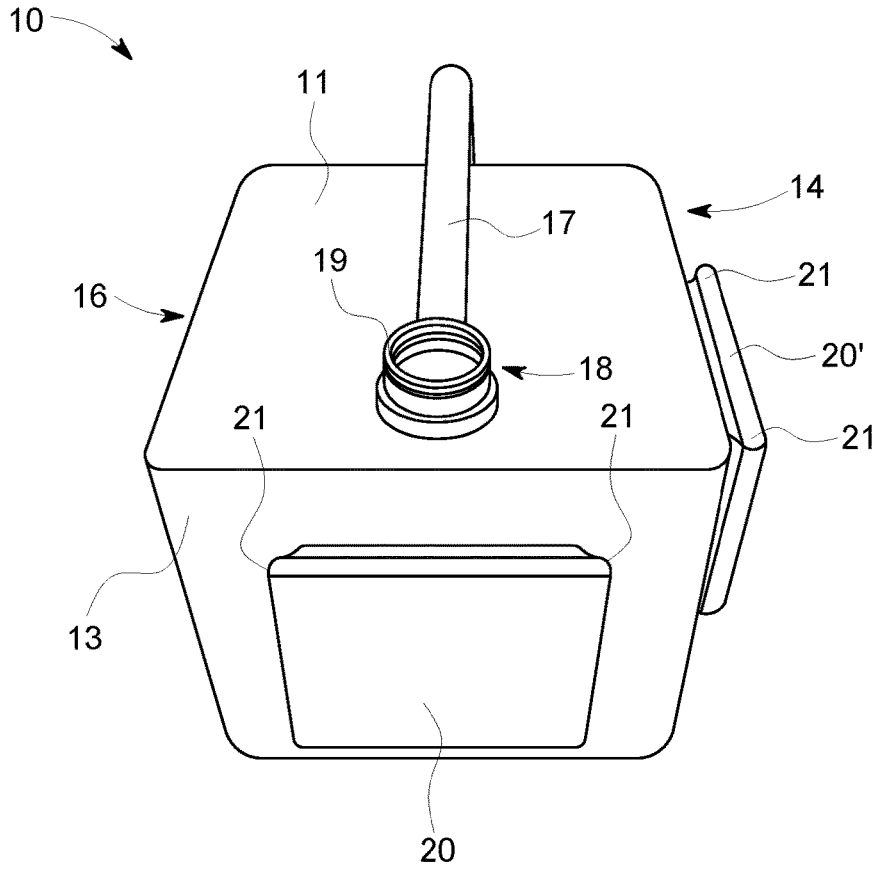
FIG. 1 shows a top, front prospective view of fluid packaging container.
Figure 2:
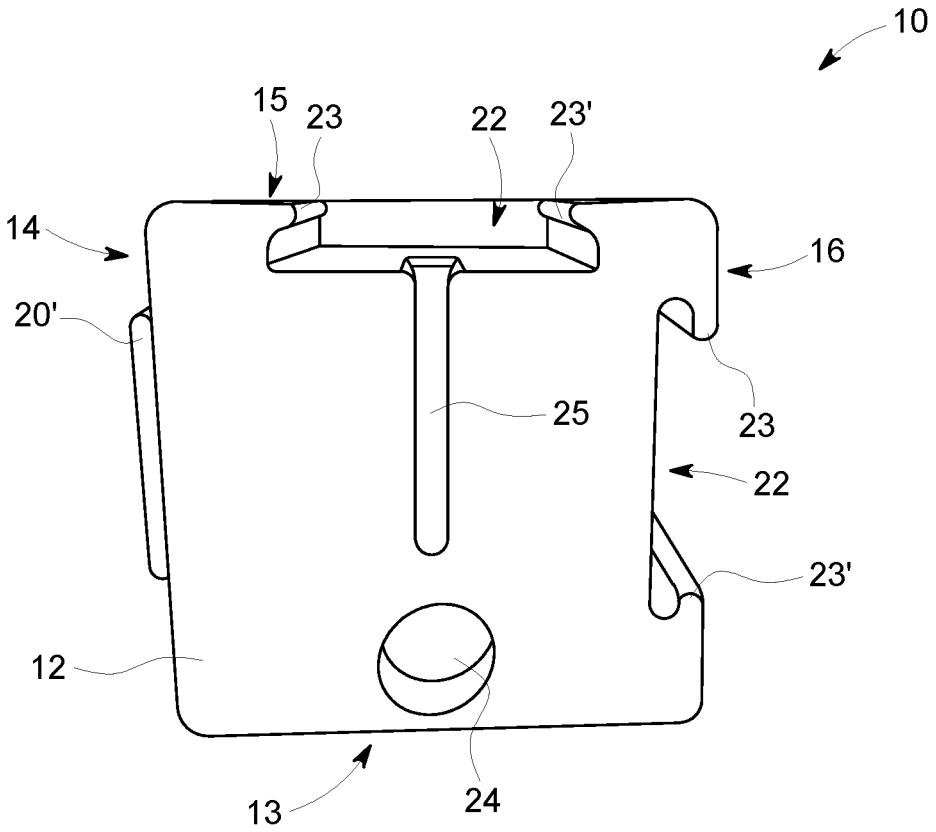
FIG. 2 pictures a bottom perspective view of the fluid packaging container of FIG. 1.

For a better understanding of the invention and its operation, turning now to the drawings, FIGS. 1-6 illustrate several views of preferred fluid packaging container 10 formed from a container body defining top surface 11, bottom surface 12, front surface 13, right side surface 14, back surface 15, and left side surface 16. The geometry of container 10 is not intended as limitation on the instant invention, so the specific number of faces may vary, but the preferred embodiment of packaging container 10 is that of a substantially hollow cube with an internal volume of approximately one (1) gallon (3.79 liters). In an alternate embodiment, the internal volume is approximately six (6) liters (1.59 gallons). In a separate embodiment, the internal volume is approximately one (1) liter (0.26 gallon). In an alternate embodiment, the internal volume of container 10 may range from 1 pint (473 mL) to several gallons. The gallon metric is very common in the United States, particularly with respect to liquids such as water or milk. The liter metric is more common outside of the United States. Further, given that one (1) liter of water weighs 2.2 pounds, six (6) liters of water represents 13.2 lbs., a weight that a man, woman, or child could carry over some distance if required to do so. While potable fluids are the primary material intended to be transported within packaging container 10, anything that can easily be poured out of the container may likely be transported therein, non-limiting examples including non-potable fluids such as oil, gasoline, paint, and paint thinner and edible or granular materials such as salt, sugar, flour, syrup, dried beans, and rice.

Figure 3:
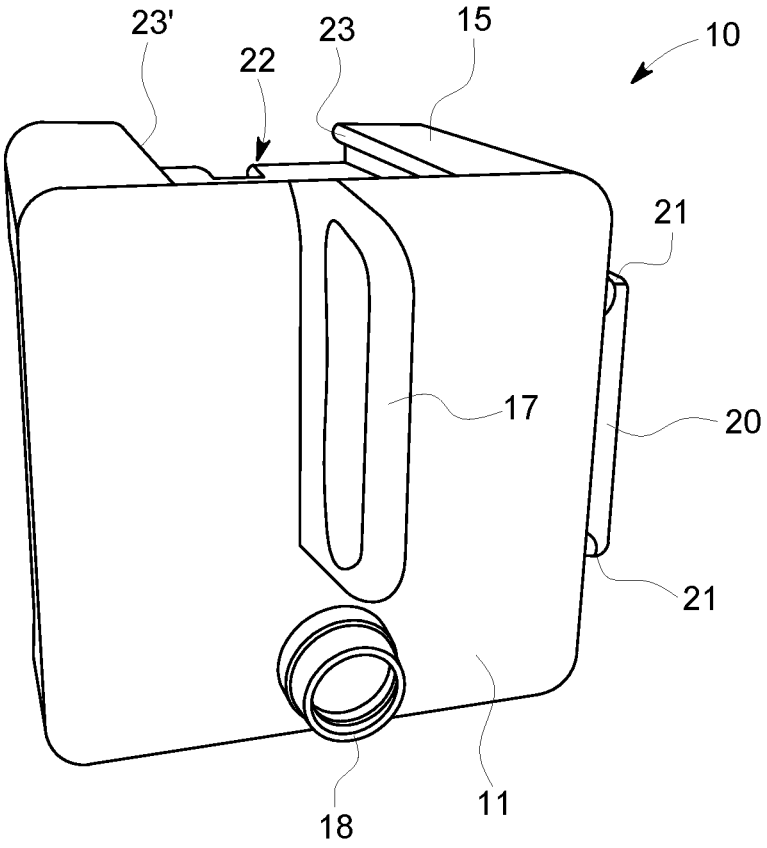
FIG. 3 a perspective top view of the fluid packaging container of FIG. 1.
Figure 4:
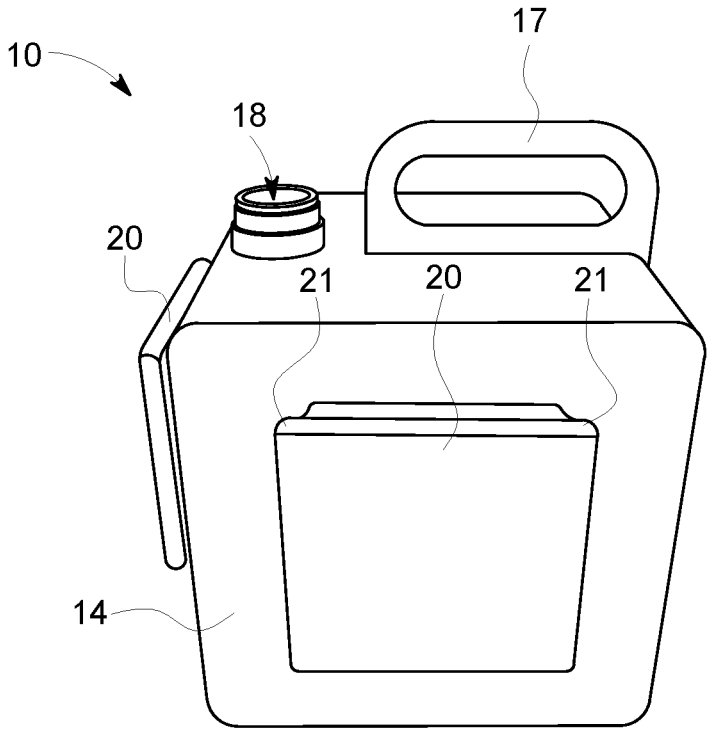
FIG. 4 demonstrates a right side view of the fluid packaging container of FIG. 1.
Figure 5:
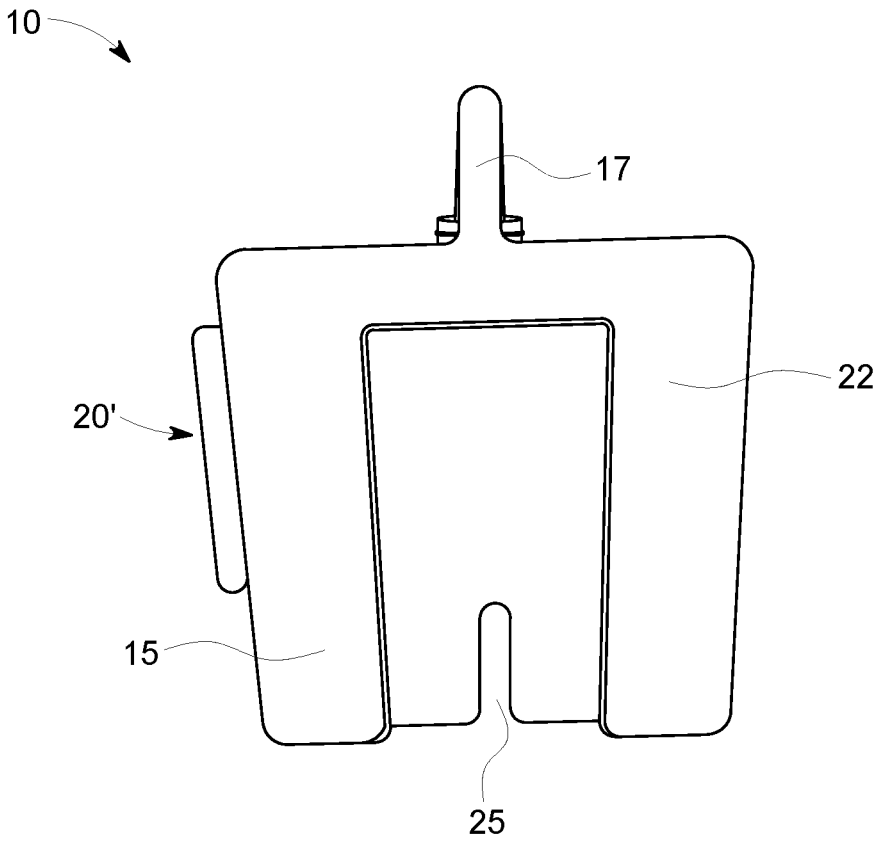
FIG. 5 illustrates a back view of the fluid packaging container of FIG. 1.
Figure 6:
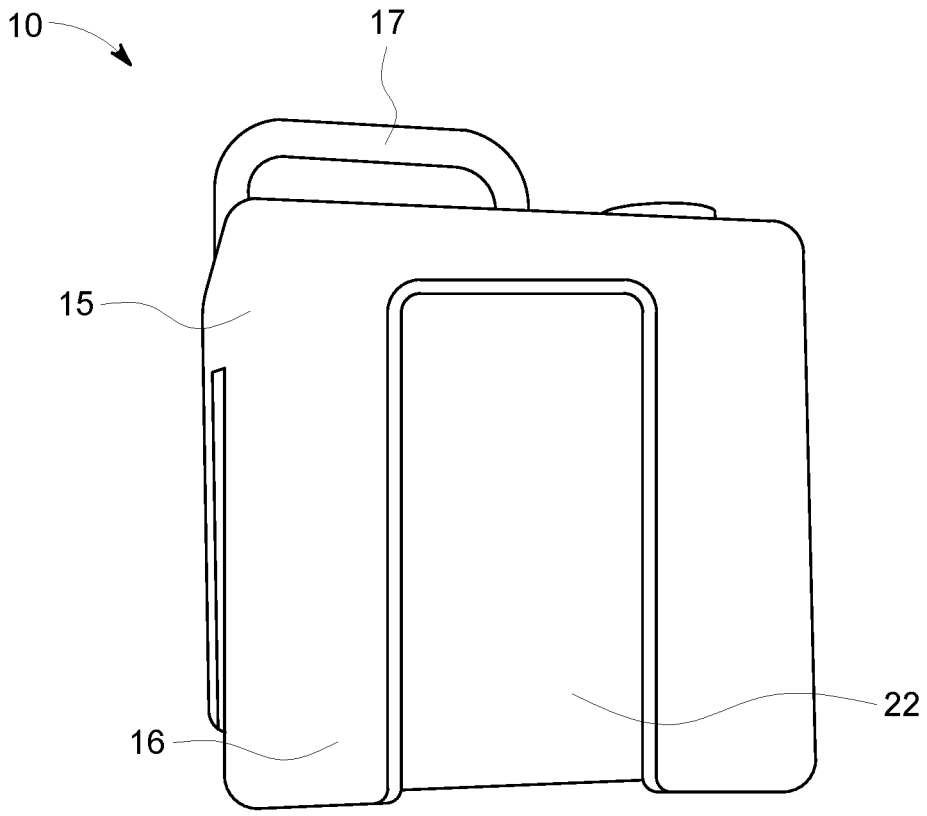
FIG. 6 features a left side view of the fluid packaging container of FIG. 1.

As demonstrated at least in FIGS. 1, 3, and 4, top surface 11 preferably defines handle 17 and spout 18. An embodiment of spout 18 is an orifice formed in the exterior surface of container 10 leading to the hollow reservoir (not shown) therein, the orifice defined by a collar 19 that may be threaded to receive a cap thereon. An alternate embodiment of collar 19 may be sized and shaped to mechanically receive some variant of stopper, for example formed from a thermoplastic or a resilient material such as rubber or other elastomeric material therein. Additionally, or in the alternative, embodiments of collar 19 may include a seal (not shown), for example a foil seal, to preserve the integrity of the contents therein. Although not shown as would be understood a variety of caps, tops, stoppers, and the like suitably sized to cover collar 19 and/or spout 18 to prevent spillage, evaporation and the like are contemplated. Embodiments of container 10 (not shown) may include a plurality of orifices, but preferably include at least one to insert fluids such as potable water, milk, juice, soda, or the like therein, and subsequently recover said fluids or materials at a later time. Embodiments of collar 19 may be tapered for ease of pouring contained fluids out of container 10 or be formed from an extendable/retractable material such that collar 19 can be extended during use but collapsed for storage when not in use. Handle 17 is preferably a tubular or cylindrical structure, either defined as a separate component from container 10 or integrally formed, in one non-limiting example by molding, therewith. It should be understood that embodiments of handle 17 preferably define one or more sufficient void(s) between top surface 11 and handle 17 to accommodate a range of human hand sizes therein.

Preferred packaging container 10 defines a plurality (i.e. one or more) of faces with a protrusion defined thereon. As best seen in FIGS. 1 and 4, preferred protrusions 20, 20' define a substantially square shape with a surface area less than the face on which it is defined. In one embodiment, protrusions 20, 20' are formed on adjacent side surfaces 13, 14. Embodiments of protrusion 20 extend approximately one (1) inch (2.54 cm) away from the exterior surface of packaging container 10. Additionally, or in the alternative, embodiments of protrusion 20 extend a short distance (i.e. about ¼ of an inch or 0.64 cm) substantially parallel to the associated exterior surface of packaging container 10, defining a lip or shoulder 21. In the preferred embodiment, the lateral sides of protrusions 20, 20' define the described shoulder 21 while the longitudinal top and bottom sides do not, facilitating an easier engagement and/or disengagement from recesses 22, 22'. However, all sides in the illustrated embodiment define shoulder 21 to indicate that any configuration or orientation of shoulders 21 relative to the sides of protrusion 20 should be considered within the scope of this invention. As will be described in further detail below, embodiments of shoulder 21 may engage or otherwise be received within recesses 22, 22' so that packaging containers 10 may be joined together to form a structure.

Preferred packaging container 10 defines a plurality (i.e. one or more) of faces with a recess defined therein. As best seen in FIGS. 2, 3, 5, and 6 preferred recess 22 defines a substantially square or rectangular shape with a surface area less than the face in which it is defined. In one embodiment, recesses 22, 22' are formed in adjacent side surfaces 15, 16. Embodiments of recess 22 descend approximately one (1) inch (2.54 cm) into the exterior surface of packaging container 10. Additionally, or in the alternative, embodiments of recess 22 include opposingly oriented fingers 23, 23' (FIGS. 2 and 3) positioned on either side of recess 22 that extend a short distance (i.e. about ¼ of an inch or 0.64 cm) substantially parallel to the associated exterior surface of packaging container 10. As would be understood protrusions 20, 20' are inserted within recesses 22, 22', and specifically shoulders 21 pass within and mechanically engage fingers 23, 23'.

As noted previously, preferred fluid packaging container 10 defines spout 18 in top surface 11. In one intended use, two or more packaging containers may be mechanically engaged together to form a structure. While protrusions 20 have been described herein as substantially square, other geometries of such a projection may be advantageous, for example a rectangle, and therefore are within the scope of the instant invention. Additionally, or in the alternative, it may be advantageous to vary the orientation of packaging containers in the assembly of a structure. Therefore, the preferred embodiment of packaging container 10 includes notch 24 (FIG. 2) defined therein. It is preferable that notch 24 define a size and shape commensurate with spout 18, such that spout 18 and corresponding cap/top (not shown) may be received within notch 24. Notch 24 may be formed on any exterior surface of container 10, but as best viewed in FIG. 2, preferred notch 24 is defined in bottom surface 12. One or more embodiments of packaging container 10 may also include channel 25 defined in an exterior surface therein. It is preferable that channel 25 define a size and shape commensurate with handle 17, such that handle 17 may be received within channel 25 when stacked. Channel 25 may be formed on any exterior surface of packaging container 10, but as best viewed in FIGS. 2 and 5, preferred channel 25 is defined in bottom surface 12. Due to the geometry of handle 17, it may be advantageous for a portion of channel 25 to be formed in an adjacent surface such as side surface 15, to permit for flush engagement between joined packaging containers when assembling a structure.

A method of forming a structure utilizing packaging containers 10 previously used to transport consumable or non-consumable fluids, pellets, or granularized materials is also included. The method includes forming a packaging container of the type described above out of a material such as rubber, thermoplastic, polyethylene, polypropylene, polyvinyl chloride (PET, HDPE, LDPE, and the like) or any other non-absorbent material in a commercial process, such as blow molding. Several packaging containers 10 are provided and filled with a desired fluid such as water, milk, juice, soda, or the like to a specified volume, either predetermined or predicated on the internal volume of packaging container 10, for example 1 liter, 6 liters, or 1 gallon, or other desirable volumes, and thereafter sealed. The packaging containers are transported to a destination, ideally proximal to the population who requested the fluids and/or materials and distributed accordingly. The contents are maintained within the packaging containers 10 until such time as they are removed from the respective containers via spout 18. The containers once emptied may be assembled to faun a structure such as a wall or roof Additionally, or in the alternative, the containers 10 may be refilled, for example with dirt, concrete, or any other material, to increase their structural stability as well as their insulative utility (so-called "R value"). Specifically, one or more projections 20 of a first packaging container 10 can be aligned with the recesses 22 of a second packaging container 10 and mechanically engaged with one another such that the two packaging containers 10 are releasably attached side by side (or front to back) relative to one another. Preferably, shoulders 21 of the first packaging container 10 are received within, and mechanically engage with fingers 23 to form the described engagement. Additionally, or in the alternative, spout 18 of the first container 10 is received within notch 24 of an adjacent packaging container 10 to permit vertical stacking for the formation of larger structures. Additionally, or in the alternative, handle 17 of the first container 10 is received within channel 25 of an adjacent packaging container 10, further facilitating the substantially flush mating of numerous packaging containers 10 together to form the desired structure(s). This utility of interlocking packaging containers 10 after disgorging the materials stored and/or transported therein is considered beneficial, as it is an environmentally superior alternative to provide building blocks to create much needed structures, such as housing, versus discarding the vessels once emptied.

The illustrations and examples provided herein are for explanatory purposes and are not intended to limit the scope of the appended claims.

I claim:

1. A packaging container for the transportation of potable or non-potable materials therein comprising a first side surface defining a first protrusion extending from an exterior surface thereof and a second side surface defining a second protrusion extending from an exterior surface thereof, the first and second side surfaces oriented as adjacent surfaces of the packaging container, the first and second protrusions each extending away from said associated first and second side surface to define a shoulder, each shoulder extending substantially parallel relative to said associated first and second side surfaces beyond the first and second protrusions, respectively, and a third side surface defining a first recess formed in an exterior surface thereof and a fourth side surface defining a second recess formed in an exterior surface thereof, the third and fourth side surfaces oriented as adjacent surfaces of the packaging container, the first and second recesses each define a plurality of fingers extending substantially parallel relative to the third and fourth side surfaces, respectively a fifth surface defining a spout and a handle formed in an exterior surface thereof, the fifth surface oriented as an adjacent surface to at least one of the exterior surfaces defining a protrusion and at least one of the exterior surfaces defining a recess, a sixth surface defining a notch and a channel each formed in an exterior surface thereof, the notch sized and shaped to receive the spout therein and the channel sized and shaped to receive the handle therein, the sixth surface oriented as an adjacent surface to at least one of the exterior surfaces defining a protrusion and at least one of the exterior surfaces defining a recess wherein the first and second protrusion via the shoulders are each sized and shaped to be inserted within different ones of the first and second recesses, and the first and second recesses via the fingers are each sized and shaped to receive different ones of the first and second protrusions therein, and wherein the packaging container is configured to be attached to a second packaging container via at least one of the protrusions and its associated shoulder and at least one of the recesses and its associated plurality of fingers in both a horizontal and a vertical direction.

2. The packaging container of claim 1, wherein the packaging container defines a substantially hollow cube shape.

3. The packaging container of claim 1, wherein the first and second protrusions each define a substantially square shape, each with a surface area less than the side surface on which it is defined.

4. The packaging container of claim 3, wherein the first and second protrusions each extend approximately one inch (2.54 cm) away from the side surface on which it is defined.

5. The packaging container of claim 1, wherein each shoulder extends about ¼ of an inch (0.64 cm) beyond said first and second protrusions and substantially parallel to the associated the side surface on which the first and second protrusions are defined.

6. The packaging container of claim 1, wherein each protrusion defines at least one longitudinal side and at least one lateral side relative to the protrusion, and wherein each shoulder is defined on the at least one lateral side.

7. The packaging container of claim 1, wherein the first and second recesses each define a substantially square shape, each with a surface area less than the side surface on which it is defined.

8. The packaging container of claim 7, wherein the first and second recesses each extend approximately one inch (2.54 cm) into the side surface on which it is defined.

9. The packaging container of claim 1, wherein each of the plurality of fingers extends about ¼ of an inch (0.64 cm) beyond said first and second recesses and substantially parallel to the associated the side surface on which the first and second recesses are defined.

10. A packaging container for the transportation of potable or non-potable materials therein defining a substantially hollow cube shape and consisting of a first side surface defining a first protrusion extending from an exterior surface thereof and a second side surface defining a second protrusion extending from an exterior surface thereof, the first and second side surfaces oriented as adjacent surfaces of the packaging container, the first and second protrusions each extending away from said associated first and second side surface to define a shoulder, each protrusion defining a substantially square shape, each with a surface area less than the side surface on which it is defined, each shoulder extending substantially parallel relative to said associated first and second side surfaces beyond the first and second protrusions, respectively, and a third side surface defining a first recess formed in an exterior surface thereof and a fourth side surface defining a second recess formed in an exterior surface thereof, the third and fourth side surfaces oriented as adjacent surfaces of the packaging container, each of the recesses a substantially square shape, each with a surface area less than the side surface on which it is defined, the first and second recesses each define a plurality of fingers extending substantially parallel relative to the third and fourth side surfaces, respectively a fifth surface defining a spout and a handle formed in an exterior surface thereof, the fifth surface oriented as an adjacent surface to at least one of the exterior surfaces defining a protrusion and at least one of the exterior surfaces defining a recess, a sixth surface defining a notch and a channel each formed in an exterior surface thereof, the notch sized and shaped to receive the spout therein and the channel sized and shaped to receive the handle therein, the sixth surface oriented as an adjacent surface to at least one of the exterior surfaces defining a protrusion and at least one of the exterior surfaces defining a recess wherein the first and second protrusion via the shoulders are each sized and shaped to be inserted within different ones of the first and second recesses, and the first and second recesses via the fingers are each sized and shaped to receive different ones of the first and second protrusions therein, and wherein the packaging container is configured to be attached to a second packaging container via at least one of the protrusions and its associated shoulder and at least one of the recesses and its associated plurality of fingers in both a horizontal and a vertical direction.

11. The packaging container of claim 10, wherein the first and second protrusions each extend approximately one inch (2.54 cm) away from the side surface on which it is defined.

12. The packaging container of claim 10, wherein each shoulder extends about ¼ of an inch (0.64 cm) beyond said first and second protrusions and substantially parallel to the associated the side surface on which the first and second protrusions are defined.

13. The packaging container of claim 10, wherein each protrusion defines at least one longitudinal side and at least one lateral side relative to the protrusion, and wherein each shoulder is defined on the at least one lateral side.

14. The packaging container of claim 10, wherein the first and second recesses each extend approximately one inch (2.54 cm) into the side surface on which it is defined.

15. The packaging container of claim 10, wherein each of the plurality of fingers extends about ¼ of an inch (0.64 cm) beyond said first and second recesses and substantially parallel to the associated the side surface on which the first and second recesses are defined.

* * * * *